United States Patent [19]

Malec

[11] 4,231,883

[45] Nov. 4, 1980

[54] LUBRICANT COMPOSITION

[75] Inventor: Robert E. Malec, Birmingham, Mich.

[73] Assignee: Ethyl Corporation, Richmond, Va.

[21] Appl. No.: 36,073

[22] Filed: May 4, 1979

[51] Int. Cl.[3] ..... C10M 1/32; C10M 1/40

[52] U.S. Cl. ..... 252/33.4; 252/51.5 R

[58] Field of Search ..... 44/72; 252/51.5 R, 33.4

[56] References Cited

U.S. PATENT DOCUMENTS

| | | | |
|---|---|---|---|
| 2,917,160 | 12/1959 | Turinsky | 252/51.5 R |
| 3,115,400 | 12/1963 | Marsh et al. | 44/72 |
| 3,219,666 | 11/1965 | Norman et al. | 252/51.5 R |
| 4,071,460 | 1/1978 | Pardee | 252/51.5 R |

*Primary Examiner*—Winston A. Douglas
*Assistant Examiner*—Y. Harris-Smith
*Attorney, Agent, or Firm*—Donald L. Johnson; Robert A. Linn; Joseph D. Odenweller

[57] ABSTRACT

Friction of internal combustion engines is reduced by using a lubricating oil or fuel containing an alkoxylated hydrocarbyl amine, e.g. N,N-bis(2-hydroxyethyl-)oleylamine.

7 Claims, No Drawings

LUBRICANT COMPOSITION

BACKGROUND OF THE INVENTION

In order to conserve energy, automobiles are now being engineered to give improved gasoline mileage compared to those in recent years. This effort is of great urgency as a result of Federal regulations recently enacted which compel auto manufacturers to achieve prescribed gasoline mileage. These regulations are to conserve crude oil. In an effort to achieve the required mileage, new cars are being down-sized and made much ligher. However, there are limits in this approach beyond which the cars will not accommodate a typical family.

Another way to improve fuel mileage is to reduce engine friction. The present invention is concerned with this latter approach.

SUMMARY

According to the present invention the friction of sliding metal surfaces in an internal combustion engine is reduced by using a lubricating oil in the engine crankcase which contains an alkoxylated aliphatic hydrocarbyl amine. The additives can also be added to the engine fuel.

DESCRIPTION OF THE PREFERRED EMBODIMENTS

A preferred embodiment of the invention is a lubricating oil containing a minor friction-reducing amount of an oil-soluble additive having the formula

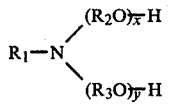

wherein $R_1$ is an aliphatic hydrocarbon group containing about 12–36 carbon atoms, $R_2$ and $R_3$ are divalent hydrocarbon radicals containing 2–4 carbon atoms and x and y are integers from 1 to 4 such that the total of x+y is 2 to about 6.

Examples of these additives are:

N,N-bis(2-hydroxyethyl)-n-dodecylamine
N,N-bis(2-hydroxyethoxyethyl)-1-methyl-undecylamine
N,N-bis(2-hydroxy-1-methylethyl)-n-tetradecylamine
N,N-bis(2-hydroxyethyl)-n-hexadecylamine
N,N-bis(2-hydroxybutyl)-n-hexadecylamine
N,N-bis(2-hydroxyethoxy ethoxyethyl)-1-ethyl-octadecylamine
N,N-bis(2-hydroxyethyl)-n-octadecylamine
N,N-bis(2-hydroxyethyl)-n-octadecenylamine
N-(2-hydroxyethyl)-N-(2-hydroxy-1-methylethyl)-n-docosylamine
N-(2-hydroxyethyl)-N-(2-hydroxyethoxyethyl)-n-triacontylamine
N,N-bis(2-hydroxy-1-ethyl ethyl)-1-ethyl-tetracontylamine In a more preferred embodiment the sum of x+y is 2 or 3. In other words, there is at least one hydroxyalkyl substituent bonded to the amine nitrogen. Examples of these are:

N-(2-hydroxyethyl)-N-(2-hydroxyethoxyethyl)-n-dodecylamine

N,N-bis(2-hydroxypropyl)-2-ethyl tetradecylamine
N-(2-hydroxyethyl butyl)-n-hexadecenylamine
N-(2-hydroxypropyl)-N-(hydroxypropoxypropanol)-n-octadecylamine
N-(2-hydroxyethyl)-N-(hydroxyethoxy)-1-methyl-noncosylamine
N-(2-hydroxyethyl)-N-(hydroxyethoxyethyl)-n-hexatriacontylamine In a highly preferred embodiment x and y are 1 such that the additive is a N,N-bis(hydroxyalkyl)hydrocarbyl amine.

Examples of these are:

N,N-bis(2-hydroxyethyl)-n-dodecylamine
N,N-bis(2-hydroxyethyl)-2-ethyldecylamine
N,N-bis(hydroxypropyl)-1-methyltridecylamine
N(hydroxyethyl)-N-(hydroxypropyl)-n-tetradecenylamine
N,N-bis(2-hydroxyethyl)-n-octadecenylamine
N,N-bis(hydroxypropyl)-2-ethyl octadecylamine
N,N-bis(2-hydroxy-1-ethyl ethyl)-n-docosylamine
N,N-bis(2-hydroxyethyl)-hexatriacontylamine In a still more preferred embodiment the additive is a N,N-bis(2-hydroxyethyl) aliphatic hydrocarbyl amine such as:

N,N-bis(2-hydroxyethyl)-n-dodecylamine
N,N-bis(2-hydroxyethyl)-1-methyl-tridecenylamine
N,N-bis(2-hydroxyethyl)-hexadecylamine
N,N-bis(2-hydroxyethyl)-octadecylamine
N,N-bis(2-hydroxyethyl)-octadecenylamine
N,N-bis(2-hydroxyethyl)-oleylamine
N,N-bis(2-hydroxyethyl)-stearylamine
N,N-bis(2-hydroxyethyl)-undecylamine The most preferred additive is N,N-bis(2-hydroxyethyl)-oleylamine. This additive is available from Armak Company under the registered trademark "Ethomeen 0/12."

The additives are added to the lubricating oil in an amount which reduces the friction of the engine operating with the oil in the crankcase. A useful concentration is about 0.05–3 wt %. A more preferred range is about 0.1–1.0 wt %.

From the above it can be seen that the present invention provides an improved crankcase lubricating oil. Accordingly, an embodiment of the invention is an improved motor oil composition formulated for use as a crankcase lubricant in an internal combustion engine wherein the improvement comprises including in the crankcase oil an amount sufficient to reduce fuel consumption of the engine of the friction reducing additive herein described.

In a highly preferred embodiment such improved motor oil also contains an ashless dispersant and an alkaline earth metal salt of a petroleum sulfonic acid or an alkaryl sulfonic acid (e.g. alkylbenzene sulfonic acid).

The additives can be used in mineral oil or in synthetic oils of viscosity suitable for use in the crankcase of an internal combustion engine. Crankcase lubricating oils have a viscosity up to about 80 SUS at 210° F.

Mineral oils include those of suitable viscosity refined from crude oil from all sources including Gulfcoast, midcontinent, Pennsylvania, California, Alaska and the like. Various standard refinery operations can be used in processing the mineral oil.

Synthetic oil includes both hydrocarbon synthetic oil and synthetic esters. Useful synthetic hydrocarbon oils include liquid polymers of α-olefins having the proper viscosity. Especially useful are the hydrogenated liquid oligomers of $C_{6-12}$ α-olefins such as α-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylol propane tripelargonate, pentaerythritol tetracaproate, di(2-ethylhexyl)adipate, dilauryl sebacate and the like. Complex esters prepared from mixtures of mono- and dicarboxylic acid and mono- and polyhydroxyl alkanols can also be used.

Blends of mineral oil with synthetic oil are particularly useful. For example, blends of 5–25 wt % hydrogenated α-decene trimer with 75–96 wt % 150 SUS (100° F.) mineral oil results in an excellent lubricant. Likewise, blends of about 5–25 wt % di(2-ethylhexyl-)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl dithiophosphates can be used. Examples of alkyl type ZDDP are those in which the hydrocarbyl groups are a mixture of isobutyl and isoamyl alkyl groups. Likewise, an example of aryl type ZDDP is zinc di(nonylphenyl)dithiophosphate. Good results are achieved using sufficient ZDDP to provide about 0.01–0.5 wt % zinc. A preferred concentration supplies about 0.05–0.3 wt % zinc.

Other additives used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 wt % alkaline earth metal and more preferably about 0.1–1.0 wt %.

Viscosity index improvers can be included such as the polyalkylmethacrylate type or the ethylene-propylene copolymer type. Likewise, styrene-diene or styrene-acrylate VI improvers can be used. Alkaline earth metal salts of phosphosulfurized polyisobutylene are useful. Preferred crankcase oils also contain an ashless dispersant such as the polyolefin succinamides and succinimides of polyethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,172,892 and 3,219,666 incorporated herein by reference.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The above dispersants can be reacted with boric acid or ester to form boronated dispersants having improved corrosion properties.

Tests were carried out which demonstrated the friction-reducing properties of the additives. These tests have been found to correlate with fuel economy tests in automobiles. In these tests an engine with its cylinder head removed and with the test lubricating oil in its crankcase was brought to 1800 rpm by external drive. Crankcase oil was maintained at 63° C. The external drive was disconnected and the time to coast to a stop was measured. This was repeated several times with the base oil and then several times with the same oil containing one percent of N,N-bis(2-hydroxyethyl)-oleylamine. The base oil was a typical commercial oil formulated for use in a crankcase. The friction-reducing additive was found to increase the coast-down time an average of 4.9%.

Further tests were conducted using a 1977 U.S. production automobile. These were shortened versions of the Federal City EPA cycle. This is referred to as the "Hot 505" cycle. It consists of the first 3.6 miles of the Federal EPA city cycle started with a warmed-up engine instead of a cold engine. The car with a fully formulated SE grade oil in its crankcase is operated on a chassis dynamometer for about one hour at 55 mph to stabilize oil temperature. It is then run through four consecutive "Hot 505" cycles measuring fuel economy of the base oil. Results of the four cycles are averaged. Then one-half of the base oil is drained from the crankcase and replaced with the same base oil containing a double dose of the test additive. The car is then run at 55 mph for about one hour to again stabilize temperature. A second series of four consecutive "Hot 505" cycles is run to measure initial fuel economy of the base oil containing the test additive. The car is then run 500 miles at constant 55 mph. Then a third series of four consecutive "Hot 505" cycles are run to measure fuel economy after 500 miles operation on the oil containing the test additive. The crankcase is then drained hot and filled with flushing oil which is run for a short time and then drained. The crankcase is then filled with the base oil which is run for a short time and then drained. The crankcase is then filled a second time with base oil. This is run about one hour at 55 mph to a stable temperature. Then a fourth series of consecutive "Hot 505" cycles are run measuring fuel economy. This gives a second base line thus bracketing the test carried out with the friction additive between two base line tests.

The following table shows the percent improvement in fuel economy over the base oil obtained using 1 weight percent of the friction-reducing additive.

| | % Gain In Fuel Economy | | |
|---|---|---|---|
| Additive | Initial | 500 miles | Avg |
| N,N-bis(2-hydroxy-ethyl)oleylamine | 1.8 | 0.8 | 1.3 |

The reduction in fuel consumption though small is significant.

I claim:

1. In a lubricating oil composition formulated for use in the crankcase of an internal combustion engine, said lubricating oil comprising a major amount of an oil of lubricating viscosity suitable for use in an engine crankcase, the improvement wherein said composition contains a minor friction-reducing amount of an oil soluble additive having the formula

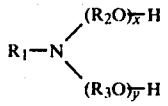

wherein $R_1$ is an aliphatic hydrocarbon group containing about 12–36 carbon atoms, $R_2$ and $R_3$ are divalent hydrocarbon radicals containing 2–4 carbon atoms and x and y is 2 to about 6, said improvement resulting in an increase in fuel economy.

2. A lubricating composition of claim 1 wherein $R_2$ and $R_3$ are the group $—CH_2—CH_2—$.

3. A lubricating composition of claim 2 wherein the total of x+y is 2 to about 3.

4. A lubricating composition of claim 2 wherein $R_1$ is an oleyl group.

5. A lubricating composition of claim 3 wherein $R_1$ is an oleyl group.

6. A lubricating composition of claim 5 wherein said additive is N,N-bis(2-hydroxyethyl)oleylamine.

7. A lubricating composition of claim 1 suitable for use in the crankcase of an internal combustion engine containing an ashless dispersant and an oil-soluble calcium or magnesium hydrocarbyl sulfonate.

* * * * *